US008962960B2

(12) United States Patent
Peil

(10) Patent No.: US 8,962,960 B2
(45) Date of Patent: Feb. 24, 2015

(54) PERCUSSIVE ACCESSORY FOR STRINGED INSTRUMENTS

(71) Applicant: Jesse Peil, Seattle, WA (US)

(72) Inventor: Jesse Peil, Seattle, WA (US)

( * ) Notice: Subject to any disclaimer, the term of this patent is extended or adjusted under 35 U.S.C. 154(b) by 0 days.

(21) Appl. No.: 13/938,805

(22) Filed: Jul. 10, 2013

(65) Prior Publication Data

US 2013/0333543 A1 Dec. 19, 2013

Related U.S. Application Data

(63) Continuation of application No. 13/044,771, filed on Mar. 10, 2011, now Pat. No. 8,546,673.

(60) Provisional application No. 61/768,321, filed on Feb. 22, 2013.

(51) Int. Cl.

| | |
|---|---|
| ***G10D 13/02*** | (2006.01) |
| ***G10D 3/00*** | (2006.01) |
| ***G10D 3/08*** | (2006.01) |

(52) U.S. Cl.

CPC ... *G10D 3/00* (2013.01); *G10D 3/08* (2013.01)
USPC ..... 84/323

(58) Field of Classification Search

USPC ..... 84/267, 290, 402–410, 323
See application file for complete search history.

(56) References Cited

U.S. PATENT DOCUMENTS

2012/0125176 A1* 5/2012 Engler ..... 84/323

* cited by examiner

*Primary Examiner* — Kimberly Lockett
(74) *Attorney, Agent, or Firm* — Richard C. Vershave; Foster Pepper PLLC

(57) ABSTRACT

A percussive device for a stringed instrument includes a support structure, an attachment component that attaches the support structure to the stringed instrument, one or more hammers attached to arms rotatably coupled to the support structure and one or more actuators rotatably coupled to the support structure. User activation of the one of the actuators causes a corresponding one of the hammers to make contact with a string of the stringed instrument. A rotational force device applies a rotational force to at least one of the hammer arms or actuators. The rotational force device includes a torsion or helical compression spring. The applied rotational force causes the hammer to be positioned not in contact with the string of the stringed instrument. The applied rotational force is overcome when an applicable force has been applied to the corresponding actuator by a user, thereby causing the at least one hammer to be positioned in contact with the corresponding string of the stringed instrument.

19 Claims, 12 Drawing Sheets

PERCUSSIVE ACCESSORY FOR STRINGED INSTRUMENTS

PRIORITY

This application claims the benefit of U.S. patent application Ser. No. 13/044,771 filed on Mar. 10, 2011 and further claims the benefit of U.S. Provisional Patent Application No. 61/768,321 filed on Feb. 22, 2013, the subject matter of each is incorporated herein by reference in its entirety.

BACKGROUND

Many mechanical means have been provided in the past for use with guitars and similarly stringed instruments, but these means have been generally directed to simplifying the plucking of the strings by replacing manual plucking with mechanical plucking means. Examples of such means are those disclosed and described in U.S. Pat. No. 921,565 (Scarlett); U.S. Pat. No. 2,429,138 (Ruf); and U.S. Pat. No. 3,292,975 (Koniecki). Means have also been provided for changing the pitch of a string as it is plucked or strummed by lengthening or shortening the string, such as is disclosed and described in U.S. Pat. No. 2,574,881 to McBride.

No known means have been heretofore provided whereby the notes of a stringed instrument can be mechanically actuated like the strings in a piano.

The present invention provides a percussive device for a stringed instrument. The percussive device includes a support structure, an attachment component that attaches the support structure to the stringed instrument, one or more hammers attached to arms rotatably coupled to the support structure and one or more actuators rotatably coupled to the support structure. User activation of the one of the actuators causes a corresponding one of the hammers to make contact with a string of the stringed instrument.

In one aspect of the invention, a rotational force device applies a rotational force to at least one of the hammer arms or actuators. The rotational force device includes a torsion or helical compression spring. The applied rotational force causes the hammer to be positioned not in contact with the string of the stringed instrument. The applied rotational force is overcome when an applicable force has been applied to the corresponding actuator by a user, thereby causing the at least one hammer to be positioned in contact with the corresponding string of the stringed instrument.

In another aspect of the invention, the support structure includes two side sections that are located on either side of the strings of the stringed instrument when the device is attached thereto. The attachment component includes a strap received through one or more slots located in the support structure.

BRIEF DESCRIPTION OF THE DRAWINGS

Preferred and alternative examples of the present invention are described in detail below with reference to the following drawings.

DETAILED DESCRIPTION

Figure 1:
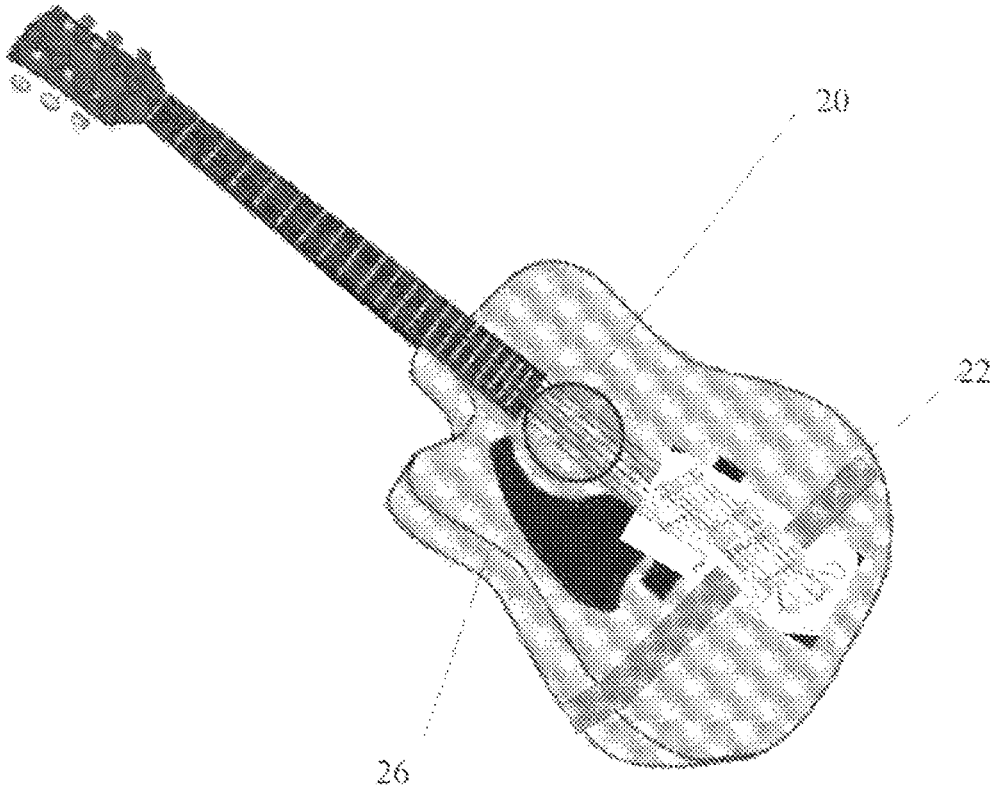
FIG. 1 is a perspective view of the present invention attached to a guitar.

FIG. 1 illustrates a perspective view of a guitar 22 and a percussive device 20 attached to the guitar 22 via a strap mechanism 26. When a user activates the percussive device 20, a percussive action is applied to the strings of the guitar 22, thereby producing a tone caused by vibration of the percussed strings.

Figure 2:
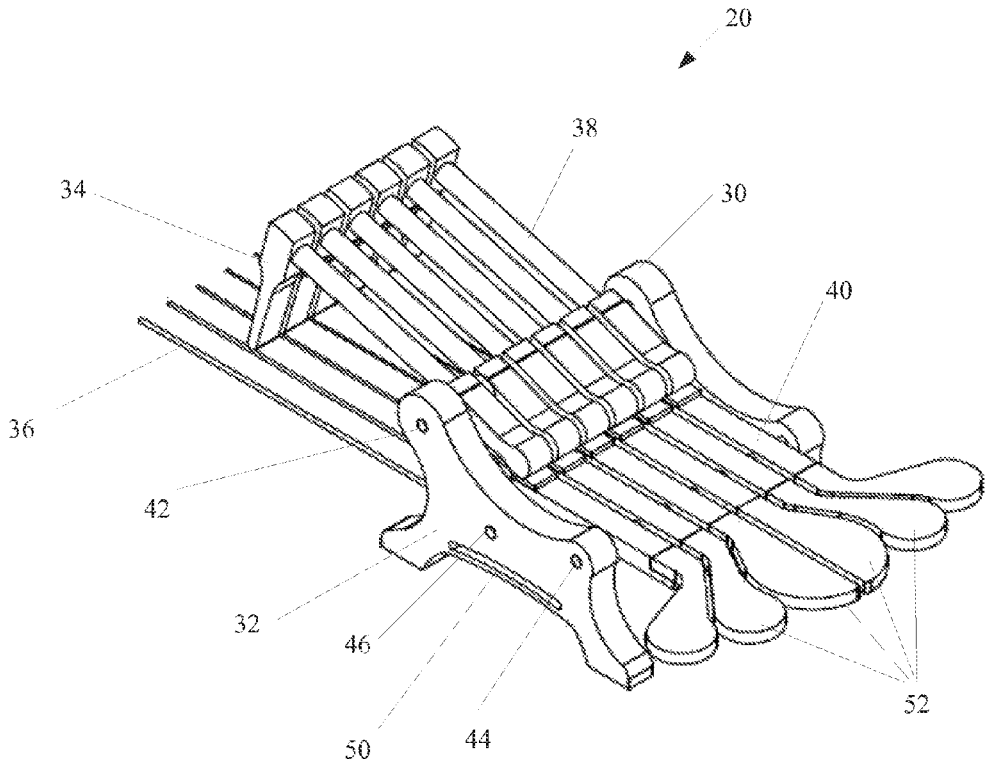
FIG. 2 is a perspective view of a percussive device formed in accordance with an embodiment of the present invention.

FIG. 2 illustrates a perspective view of the percussive device 20. The percussive device 20 includes first and second sides 30, 32 that are connected via crossbeams 42, 44, and 46. Rotatably mounted to the first crossbeam 42 are a plurality of hammer arms 38. Each of the hammer arms 38 includes a hammer head 34. The number of hammer arms 38 corresponds to the number of strings (six for the guitar 22) that the device 20 is to be attached to. Rotatably mounted to the second crossbeam 44 are a plurality of actuators 40 that are equal in number to the hammer arms 38. The third crossbeam 46 is located between the first and second crossbeams 42, 44. The third crossbeam 46 and the second crossbeam 44 are located lower on the sides 30, 32 than is the first crossbeam 42. The third crossbeam 46 is located below an interior end of the actuators 40, when the percussive device 20 is in an at-rest position. The third crossbeam 46 keeps the actuators 40 from coming in contact with the strings 36 of the guitar 22.

The percussive device 20 rests on the surface of the guitar 22 with legs of the side sections 30, 32 resting outside of the strings 36. No other portion of the percussive device 20 comes in contact with the strings 36 except for when the hammer heads 34 are activated by the user.

Interior ends of the hammer arms 38 come in contact with top surfaces of the interior ends of the actuators 40. Outboard ends of the actuators 40 include finger tabs 52 that extend beyond the frame of the sides 30, 32. The finger tabs 52 include larger surface areas than the portions of the actuators 40 located between the sides 30, 32, thereby allowing a user to make positive contact with the desired actuator.

Each of the sides 30, 32 includes a slot 50 for receiving the strap 26, as shown in FIG. 1, for attaching the percussive device 20 to a musical instrument. The slots 50 are located between legs of the sides 30, 32 and below the crossbeams 42, 44, and 46.

The percussive device 20 shown in FIG. 2 is in a relaxed position. This relaxed position is maintained by torsion springs (not shown) located where the actuators 40 make contact with the crossbeam 44 and where the hammer arms 38 make contact with the crossbeam 42. The torsion springs associated with the actuators 40 cause the actuators 40 to rotate so that the interior ends of the actuators 40 are forced to rest on the crossbeam 46. The torsion springs associated with the hammer arms 38 cause the hammer arms 38 to rotate so that an interior end of the hammer arms 38 is forced to come in contact with the respective interior ends of their associated actuators 40. When a user depresses one of the tabs of the actuator 40, the actuator 40 will rotate, thereby forcing the interior end of the actuator 40 in a vertical direction, thereby causing the respective hammer head 34 to rotate and, thus, make contact with the string that the hammer head 34 is above. Once the user has removed force from the tab 52, the percussion device 20 returns to the relaxed position.

Figure 3:
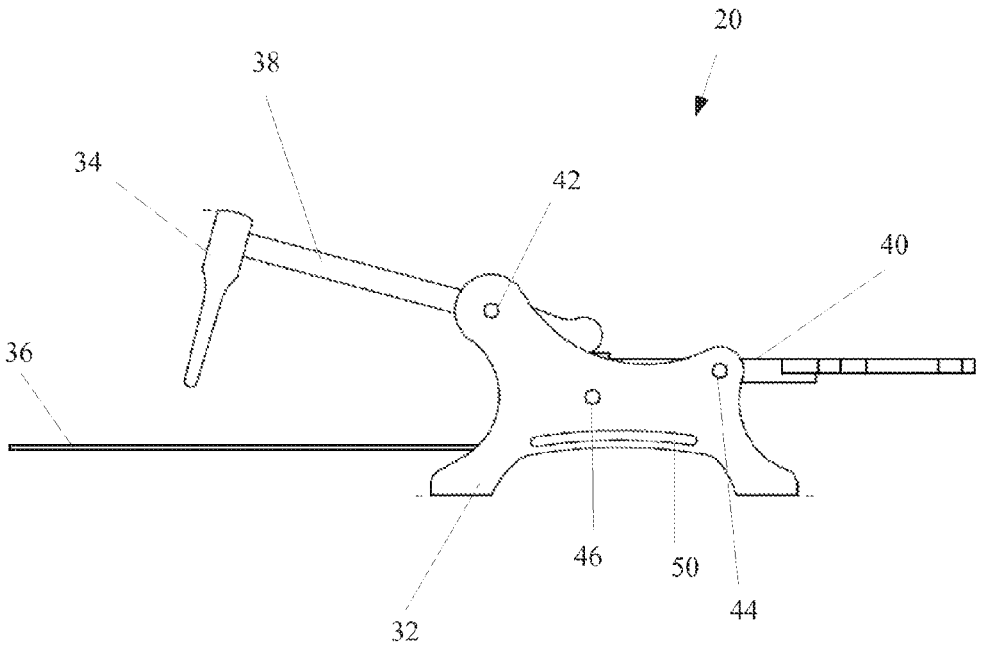
FIGS. 3 and 4 are side views of the device of FIG. 2 in different modes of operation.
Figure 4:
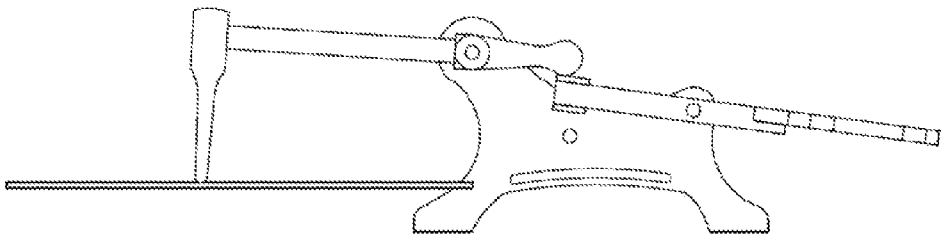

FIG. 3 shows a side view of the percussive device 20 in the relaxed position. FIG. 4 shows a side view of the percussive device 20 at the moment that the hammer head 34 strikes the respective string 36, as a result of activation of the associated actuator 40.

Figure 5:
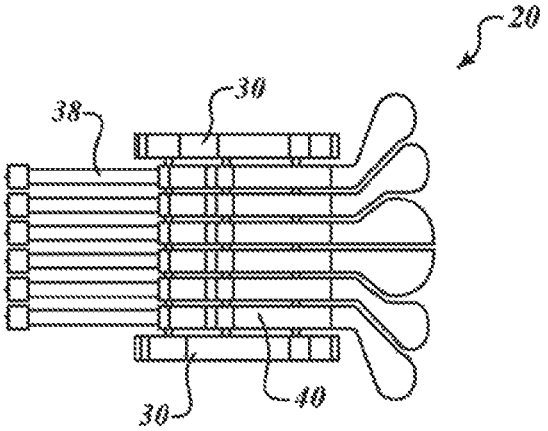
FIG. 5 is a top view of the device shown in FIG. 2.

FIG. 5 illustrates a top view of the percussive device 20 of FIGS. 1 and 4.

Figure 6:
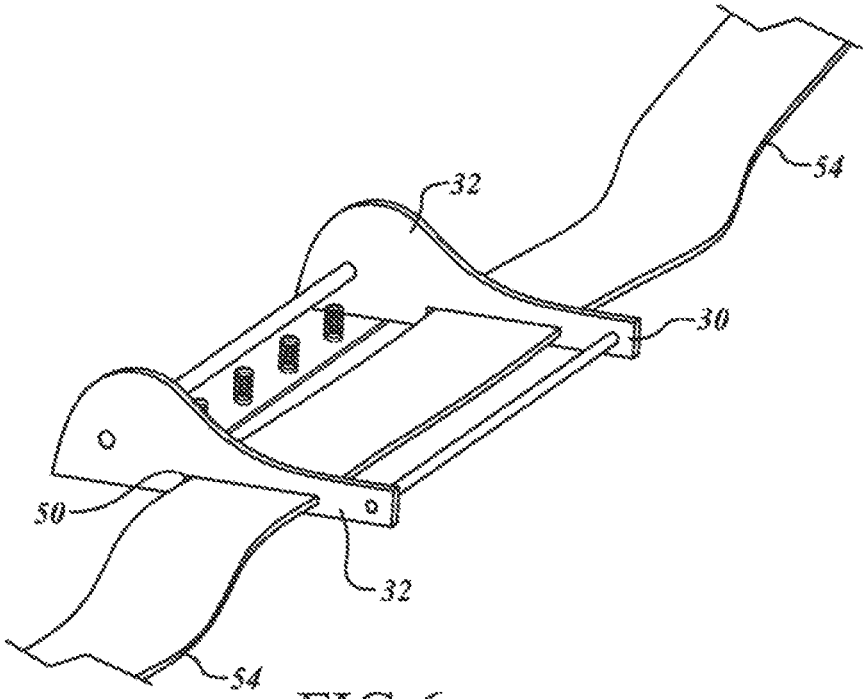
FIG. 6 is a perspective of an attachment device for the percussive device.

FIG. 6 illustrates a strap 54 that is received through the strap slots 50 of the sides 32, 30. In one embodiment, the strap 54 is long enough to wrap around the instrument and attach to itself using various types of attachment mechanisms, such as Velcro or snaps. In another embodiment, the strap 54 is attached directly to the instrument using some form of attachment mechanism. Other types of mechanisms are used for attaching the percussive device to the instrument, for example, suction cups. In another embodiment, a base is more permanently mounted to the instrument. The base does not include the working components of the percussive device. The working components of the percussive device and the base include an attachment device for allowing the working components to be quickly attached to the base. In another embodiment, a percussive device is built partially into the interior of the body of the guitar.

Figure 7A:
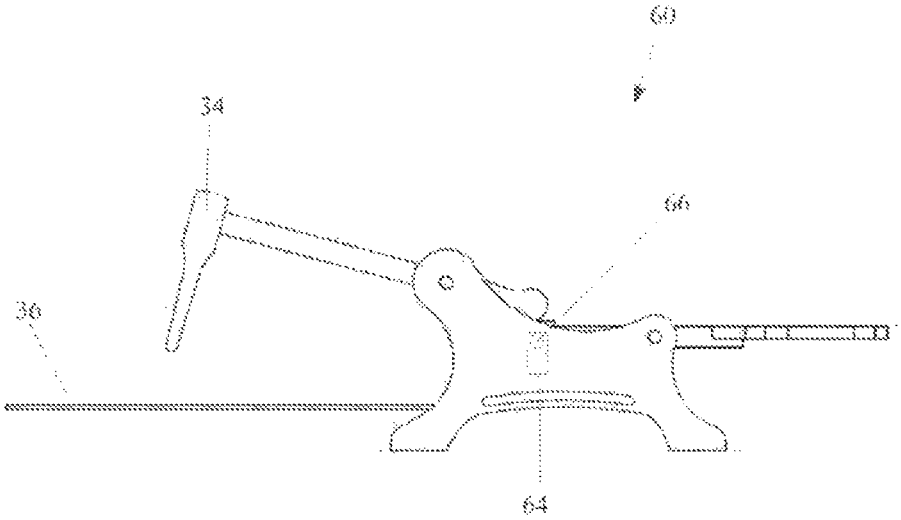
FIGS. 7A, B illustrate different operational modes in accordance with an embodiment of the present invention.
Figure 7B:
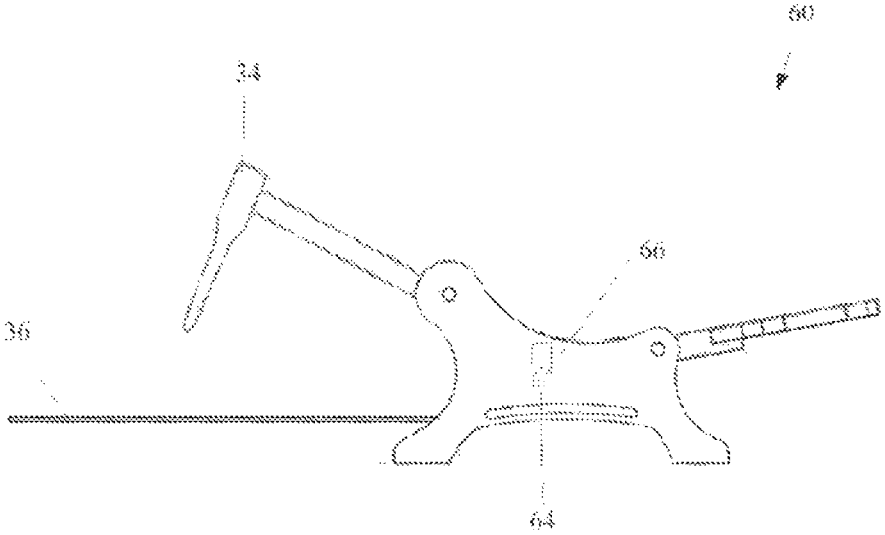

FIG. 7A illustrates a percussive device 70 in a first at rest position and FIG. 7B illustrates a percussive device 70 in a second at rest position. The difference in the at rest positions is the height of the hammer heads 34 above the strings 36. The height of the hammer heads 34 is controlled by the position of a crossbeam 66. The crossbeam 66 is supported in grooves 64 in the side sections. A securing device (not shown), such as a pin or geared dial, secures the crossbeam 66 so the crossbeam 66 doesn't move within the groove 64 after it has been set.

Figure 8:
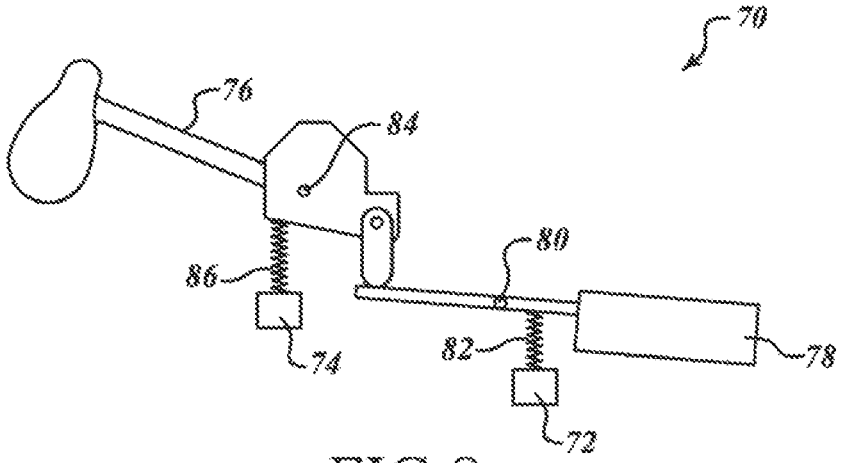
FIG. 8 is an x-ray side view of a percussive device formed in accordance with an alternate embodiment of the present invention.

FIG. 8 illustrates an x-ray side view of the operational portions of an exemplary percussive device 70. The sides of the device 70 are not shown. The percussive device 70 includes additional crossbeams 72, 74 located below actuators 78 and hammer arms 76 that rotate about crossbeams 80 and 84, respectively. These additional crossbeams 72, 74 have springs 82, 86 fixedly attached to a top surface of the crossbeams 72, 74. There is one spring 82, 86 located below each of the actuators 78 and the hammer arms 76. The springs 82, 86 are positioned such that the percussive device 70 will remain in the at-rest position, such as that shown in FIG. 3, when not being activated by a user. In other words, the force the springs 82, 86 apply to the actuators 78 and the hammer arms 76 is comparable to the force applied by the torsion springs in the embodiment shown in FIGS. 2-5.

Figure 9:
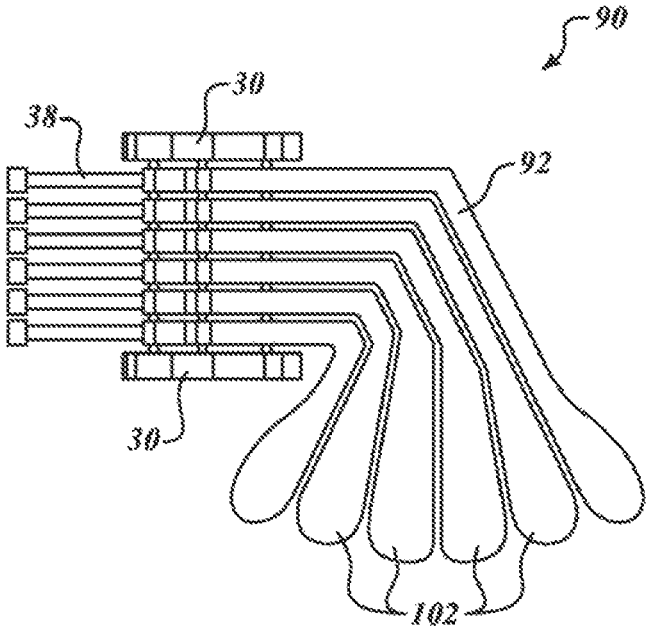
FIG. 9 is a top view of actuation members for the percussive device formed in accordance with an alternate embodiment of the present invention.

As shown in FIG. 9, a percussive device 90 includes actuators 92 that include outboard ends (tabs) 102 that fan out toward one side 30 of the percussive device 90. In this embodiment, the tabs 102 include a first end that is attached to the actuator or becomes the actuator. The tabs 102 fan out toward one of the sides 30 of the percussive device 90. This allows a user to activate the percussive device 90 from the side of the attached instrument instead of from the end of the instrument.

Figure 10:
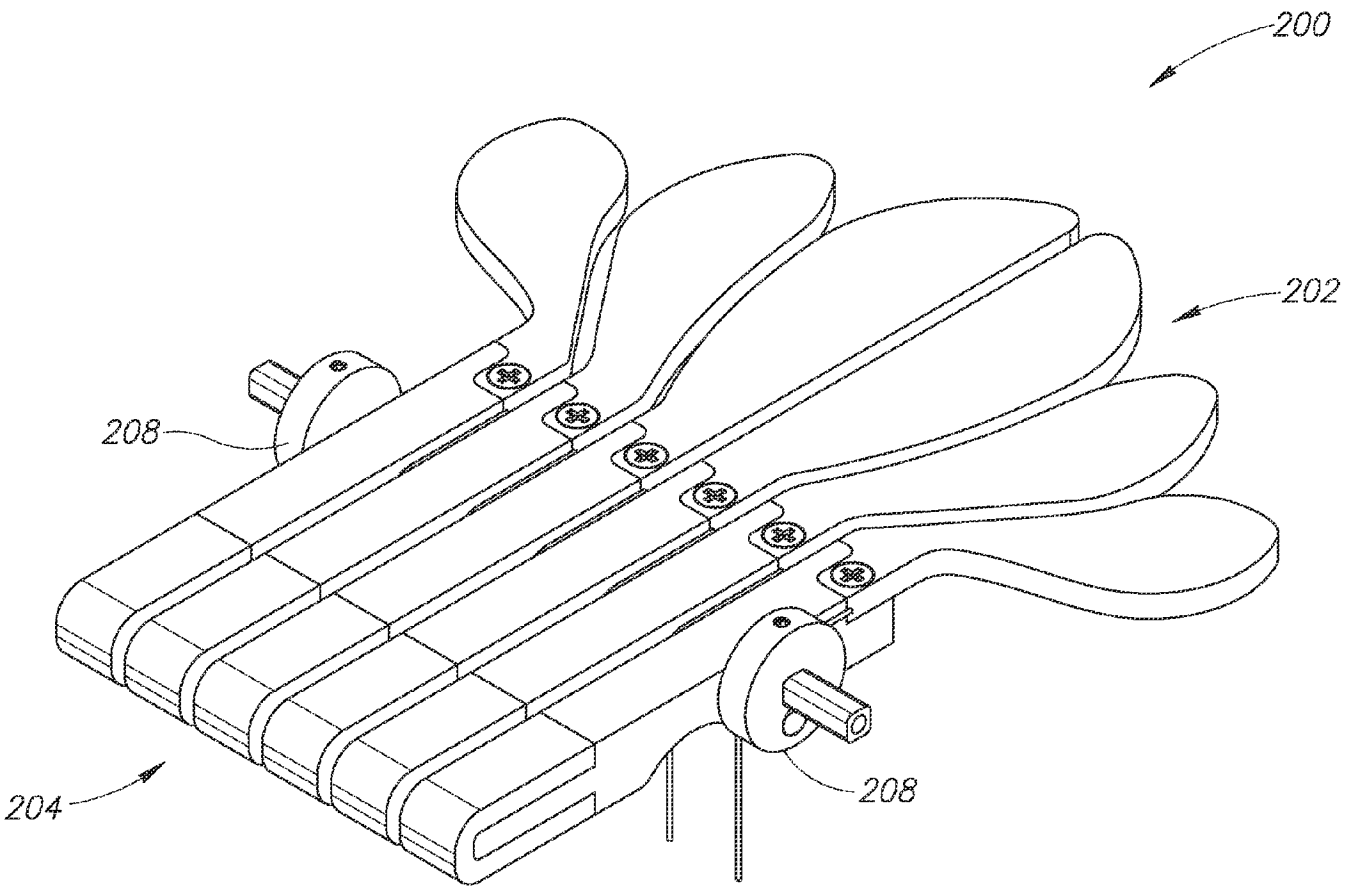
FIG. 10 is a perspective view of a subassembly with cams according to an embodiment of the present invention.
Figure 11:
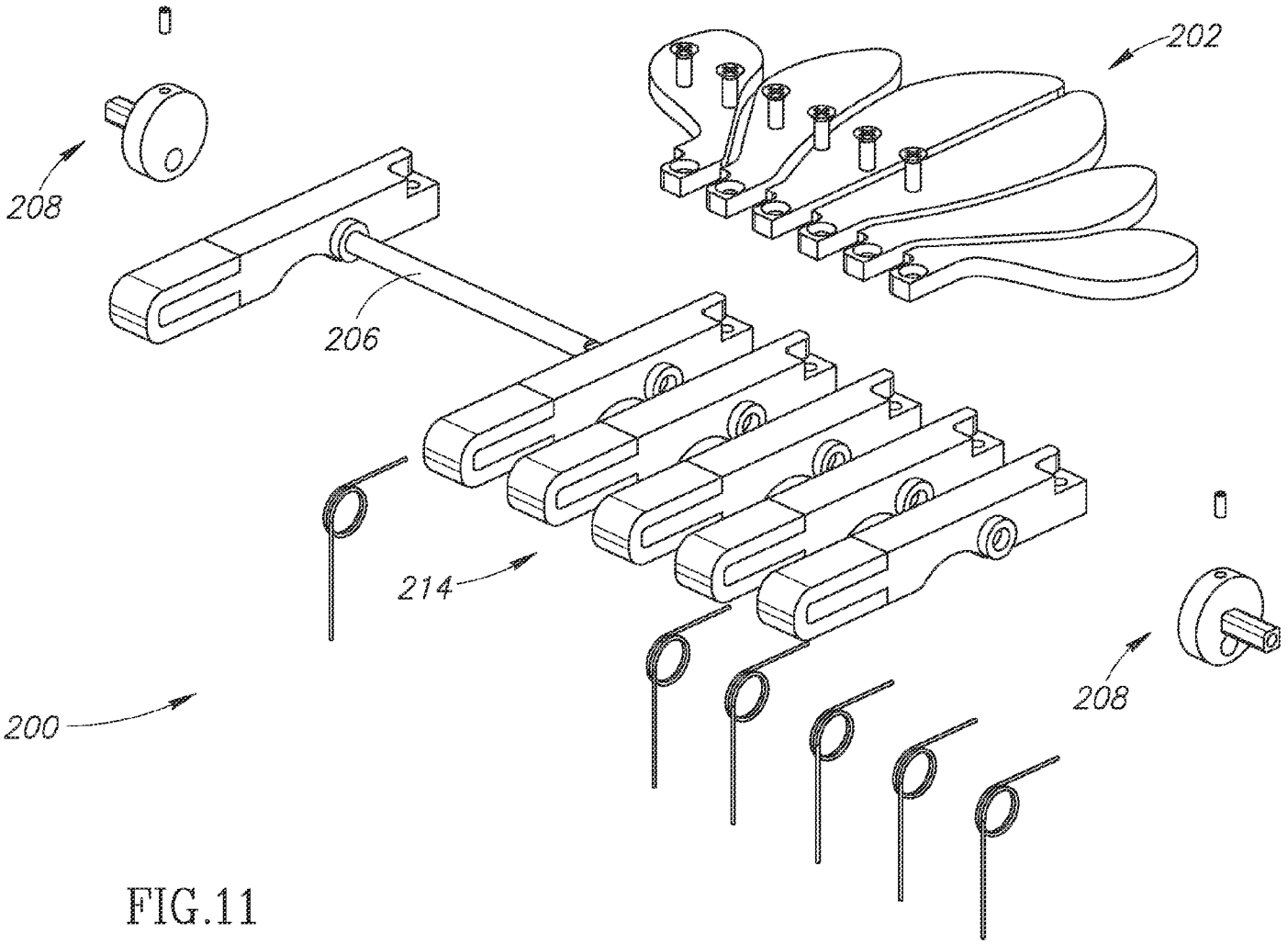
FIG. 11 is an exploded, perspective of the subassembly of FIG. 10.

FIGS. 10 and 11 show a subassembly 200 having a plurality of keys 202 fixed to fingers 204, respectively, which in turn are rotationally coupled to a crossbeam 206. A set of cams 208 includes an offset aperture 210 for receiving the crossbeam 206. In the illustrated embodiment, the crossbeam 206 may replace one or more of the crossbeams 42, 44 and/or 46 (FIGS. 1 and 2). As will be described in more detail below, the cams 208 allow a starting position of the hammer heads 34 (FIGS. 2-4) to be adjusted. Such adjustments may advantageously permit a desired level of "attack" that may be achieved when the hammer heads 34 contact the percussive strings 36. The term "attack" in music parlance refers to an extent a particular music note is achieved. In the present embodiment, the subassembly 200 enables a percussive device to be more or less sensitive to attack. An example of a conceptually similar system is a "soft pedal" system on a piano forte. In the piano, adjustment of the soft pedal system allows the hammer heads to be moved closer to or further from the piano strings. Less distance between the hammer heads and the strings generates less attack.

Figure 12:
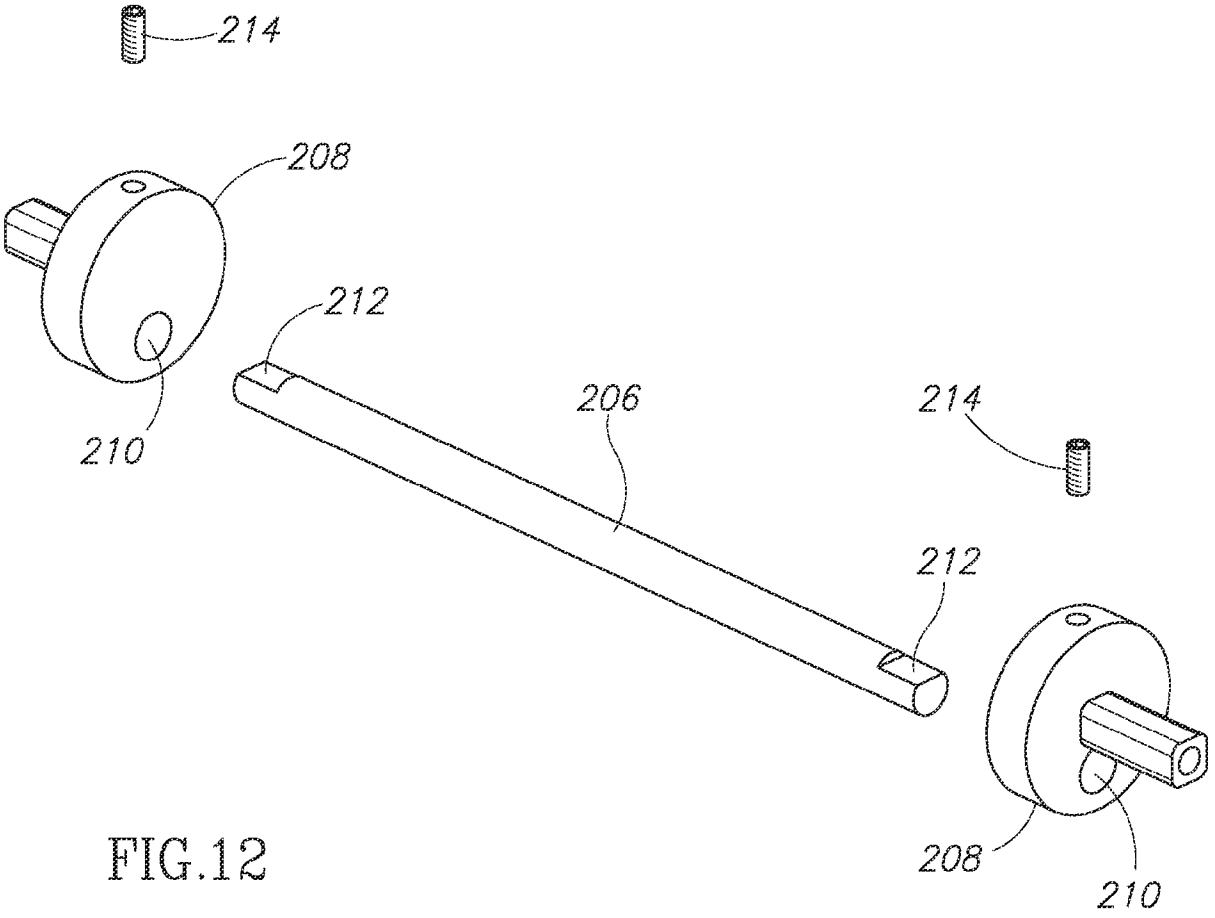
FIG. 12 is an exploded, perspective view of a crossbeam and cams according to an embodiment of the present invention.

FIG. 12 is an exploded, perspective view of the crossbeam 206 and the cams 208. The offset apertures 210 in the cams 208 receive the crossbeam 206. The crossbeam 208 may be configured with flat surfaces 212 for interacting with set screws 214 and securing the crossbeam 206 to the cams 208. Sets or kits of different sized cams 208 or same sized cams 208 having the offset aperture 210 moved slightly (e.g., less offset from the crossbeam or more offset therefrom) may be employed to achieve the desired level of attack. The side member 218 permits three different cam adjustments that advantageously allow the percussive device to be mounted to different types of stringed instruments. For example, the strings on acoustic guitars sit lower in relationship to its soundboard as compared to the strings on a bass guitar. The cams 208 enable a musician to adjust all of hammers as desired. As mentioned above, such adjustments may also be used to alter the level of attack.

Figure 13:
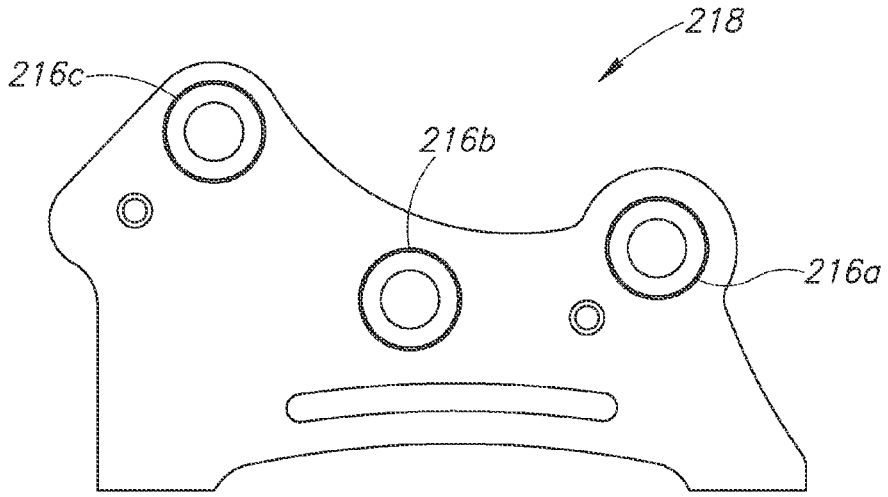
FIG. 13 is a side elevational view of a side member for the percussive device according to an embodiment of the present invention.

Briefly referring to FIG. 13, the cams 208 may received in one or more of the openings 216*a*, 216*b* and/or 216*c* located in side member 218 depending on the level of attack desired by a musician. While only one side member 218 is illustrated in FIG. 13 it is appreciated that the other side member (not shown) would be a mirror replica of the side member 218. The side members 218 may be substituted for the first and second sides 30, 32 described above with reference to FIG. 2.

Figure 14:
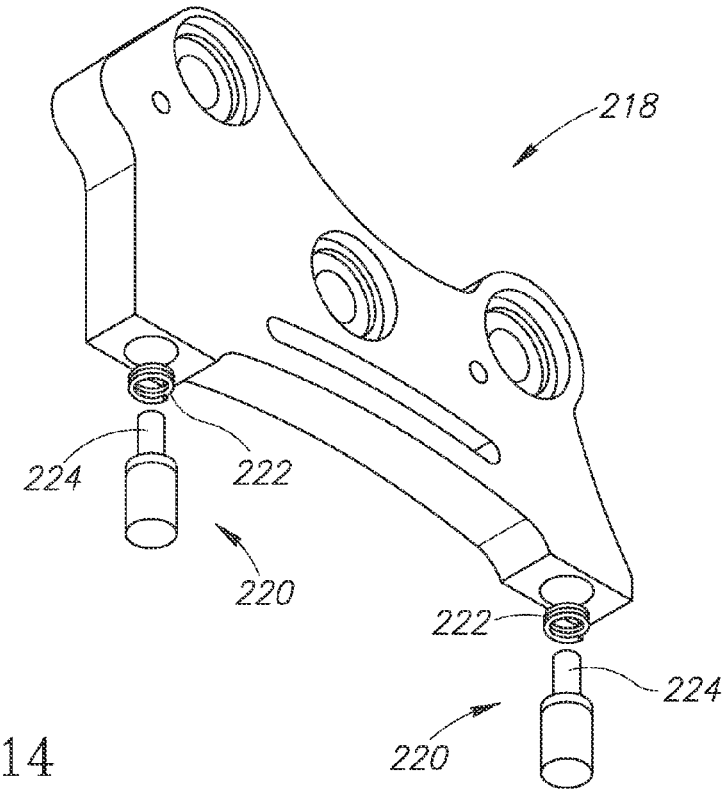
FIG. 14 is an exploded, perspective view of a side member having adjustable feet according to an embodiment of the present invention.
Figure 15:
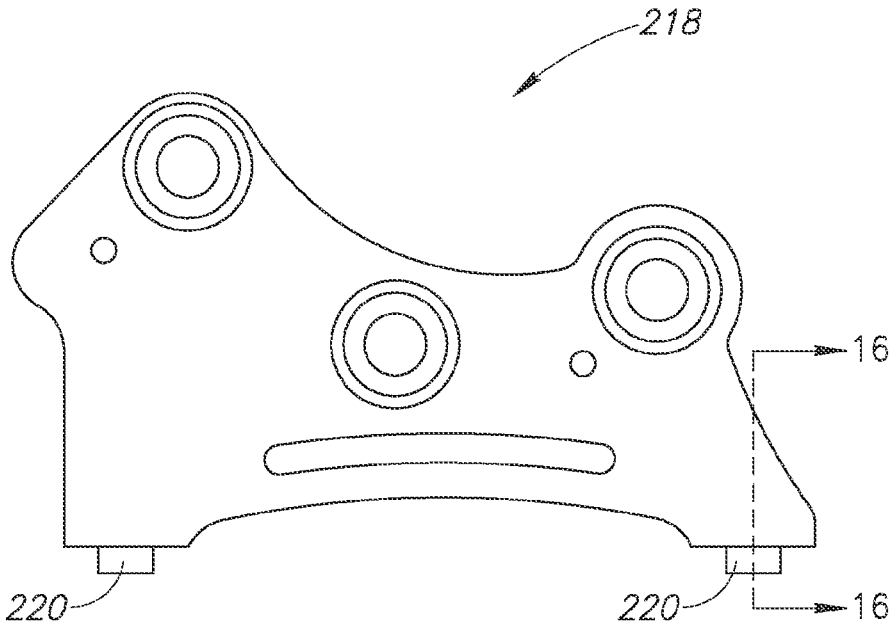
FIG. 15 is a side elevational view of the side member of FIG. 14.
Figure 16:
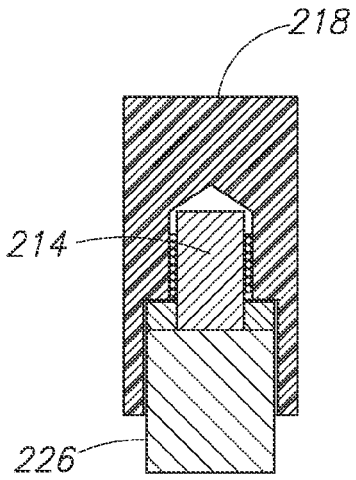
FIG. 16 is a close-up, cross-sectional view of an adjustable foot coupled to the side member of FIG. 14 according to an embodiment of the present invention.

FIGS. 14, 15 and 16 show the side member 218 with adjustable feet 220. The side member 218 includes a threaded openings 222 configured to receive threaded posts 224 extending from the feet 220. The threaded openings 222 may take the form of internally threaded sleeves press fit into the side member 218 or a threaded opening tapped directly into the side member 218. As best illustrated in FIG. 16, a bottom portion 226 of the foot 220 is fixed to the threaded post 224.

The bottom portion 226 may be made from any material such as, but not limited to, rubber or plastic materials that dampens or eliminate sound caused by movement of the percussive device relative to an instrument onto which it is installed (e.g., different types of stringed instruments such as, but not limited to guitars, ukuleles, standup bass, violin, and an electric bass). Such relative motion, without the dampening interface, may create undesirable acoustics that could diminish an overall sound quality or attach coming from playing the instrument. In addition, the feet 220 may be independently adjusted to account for installation differences on different types of instruments or to account for instruments that have contoured sound board surfaces. By way of example, a musician may desire to use the percussive device on several different guitars, so the feet 220 could be adjusted accordingly.

Figure 17:
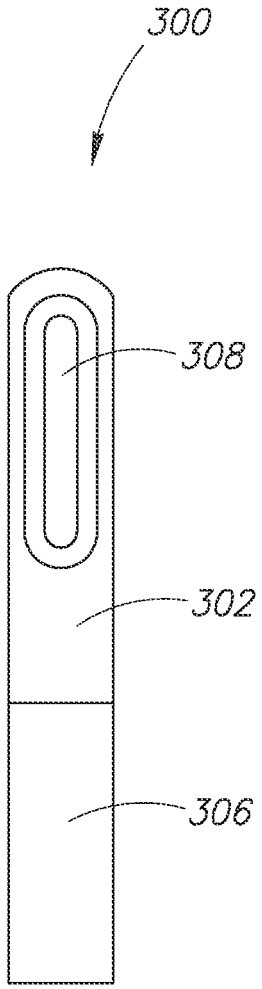
FIG. 17 is a side elevational view of a hammer head according to an embodiment of the present invention.
Figure 18:
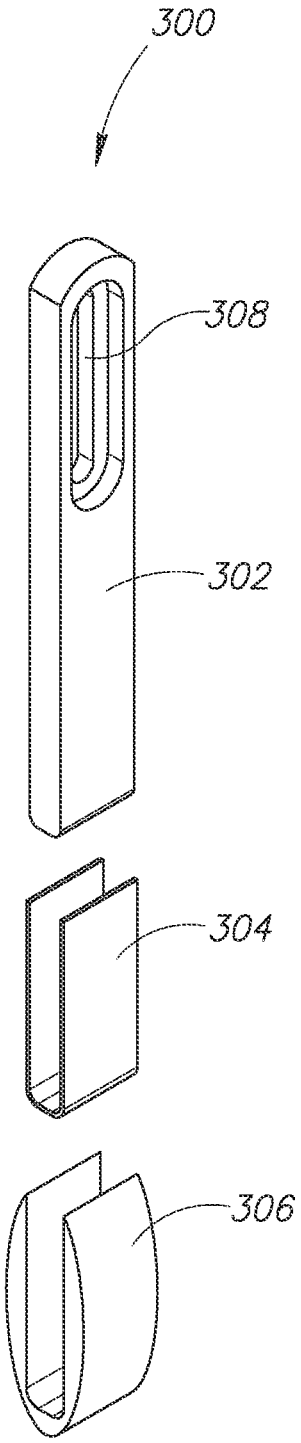
FIG. 18 is an exploded, perspective view of the hammer head of FIG. 17.

FIGS. 17 and 18 show a hammer head 300 according to another embodiment of the present invention. The hammer head 300 includes a body 302, a clip 304 and a clip cover 306. The body 302 include a slot 308 that permits the hammer head 300 to be adjusted relative to the hammer arms 38 (FIG. 2) and thus also adjusted relative to the strings of the instrument being played or about to be played. The body 302 may be secured to the hammer arms 38 using a set screw (not shown). Preferably, the cams 208 (FIG. 12) are adjusted first and then each hammer head 300 may be individually adjusted, for example to achieve more attack on just the E-string or E-note and/or to achieve a significantly different tonal quality. The clips 304 and cover 306 may be removed and replaced with other clips and/or covers made from different materials without necessitating a re-adjustment of the hammer head 300. By way of example, one cover 206 may be made of felt to achieve a softer tone on one chord while an adjacent cover may be made of metal.

Rather than using the clip 304 and cover 304, the hammer heads 300 may monolithic or unitary and removable. The musician may have a kit or set of hammer heads made from different materials that could be substituted independently to achieve an array of different sounds and effects. By way of example, the kit may include sets of hammer heads 300 made from different materials, having different densities, or combination of materials such as, but not limited to various metals, woods, felt, rubber, etc.

According to one or more of the above-described embodiments, the percussive device provides musicians an improved way to play a stringed instrument by percussively striking the strings rather than strumming or plucking the strings. The hammer heads 34 do not travel past the strings like in other devices such as the device described by Koniecki in U.S. Pat. No. 3,293,975. Also unlike Koniecki, the percussive device does not employ a dampener, aside from the mounting feet, because it is actually desirable to allow the strings to ring out after being struck. The percussive device thus advantageously allows the musician to strike the strings in a range of intensities and volume.

While the preferred embodiment of the invention has been illustrated and described, as noted above, many changes can be made without departing from the spirit and scope of the invention. For example, this invention may be scaled in size to be used with other stringed instruments, such as violin, cello, bass fiddle, etc. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A percussive device for a stringed instrument, the percussive device comprising:

a support structure having at least two side members;

a crossbeam;

a plurality of hammer heads rotationally coupled to the crossbeam;

a plurality of keys for selectively actuating the plurality of hammer heads; and a cam coupled to the crossbeam and supported by the side members, the cam having a first aperture offset relative to a center of the cam, the first aperture sized to receive an end portion of the crossbeam, wherein the location of the aperture determines a distance of the hammer heads relative to strings of the stringed instrument.

2. The device of claim 1, wherein the cam includes a second aperture offset relative to the center of the cam by a distance that is different than the first aperture.

3. The device of claim 1, the cam is coupled to the crossbeam with a set screw.

4. The device of claim 1, wherein the cam is closely received in an opening formed in at least one of the side members.

5. The device of claim 1, wherein each side member includes at least three openings to receive three cams.

6. The device of claim 1, wherein the hammer heads include a body, a detachable clip and a detachable cover.

7. The device of claim 1, wherein each cover is replaceable with a replacement cover made from a different material.

8. The device of claim 1, wherein each clip is replaceable with a replacement clip made from a different material.

9. The device of claim 1, wherein the hammer heads include slots for independently adjusting a height of each hammer head relative to the strings to the stringed instrument.

10. The device of claim 1, wherein each hammer head is replaceable with a hammer head made from a different material.

11. A percussive device for a stringed instrument, the percussive device comprising:

a support structure having at least two side members;

a crossbeam;

a plurality of hammer heads rotationally coupled to the crossbeam;

a plurality of keys for selectively actuating the plurality of hammer heads; and a plurality of mounting feet adjustably coupled to the side members, wherein the mounting feet include a sound dampening material that contacts a mounting surface of the stringed instrument when the percussive device is installed thereon.

12. The device of claim 11, wherein the side members are internally threaded to receive threaded posts extending from the mounting feet.

13. The device of claim 11, wherein the dampening material is a rubber material.

14. The device of claim 11, wherein the side members receive internally threaded sleeves for receiving threaded posts extending from the mounting feet.

15. The device of claim 11, wherein the mounting are independently adjustable relative to the side members.

16. A guitar comprising:

a body; and a percussive device having a support structure with at least two side members, a crossbeam, a plurality of hammer heads rotationally coupled to the crossbeam, a plurality of keys for selectively actuating the plurality of hammer heads, and a cam coupled to the crossbeam and supported by the side members, wherein the cam includes a first aperture offset relative to a center of the cam, the first aperture sized to receive an end portion of the crossbeam, wherein the location of the aperture determines a distance of the hammer heads relative to strings of the stringed instrument.

17. The guitar of claim 16, wherein the cam includes a second aperture offset relative to the center of the cam by a distance that is different than the first aperture.

18. The guitar of claim 16, wherein the cam is coupled to the crossbeam with a set screw.

19. The guitar of claim 16, wherein the cam is closely received in an opening formed in at least one of the side members.

* * * * *